US006378437B1

(12) United States Patent
Burke, Jr. et al.

(10) Patent No.: US 6,378,437 B1
(45) Date of Patent: Apr. 30, 2002

(54) HARDENED SUBMINITURE TELEMETRY AND SENSOR SYSTEM FOR A BALLISTIC PROJECTILE

(75) Inventors: Lawrence W. Burke, Jr., Whiteford; Michael S. L. Hollis, Abingdon; Freddie J. Brandon, Aberdeen; Eugene M. Ferguson, Baltimore; Jonah N. Faust, North East; Bradford A. Davis, Jarretsville, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/541,836

(22) Filed: Apr. 3, 2000

(51) Int. Cl.[7] ..... F42B 12/00

(52) U.S. Cl. ..... 102/293; 102/513; 102/517; 73/167

(58) Field of Search ..... 102/293, 513, 102/517, 521; 73/167; 244/3.11, 3.14

(56) References Cited

U.S. PATENT DOCUMENTS 4,515,082 A * 5/1985 Pizzurro ..... 102/293
4,951,901 A * 8/1990 Dunne ..... 244/3.11
5,280,751 A * 1/1994 Murihead et al. ..... 102/293

* cited by examiner

*Primary Examiner*—Harold J. Tudor
(74) *Attorney, Agent, or Firm*—Paul S. Clohan, Jr.; Edward L. Stolarun

(57) ABSTRACT

A hardened subminiature telemetry and sensor system for a ballistic projectile having a radome, antenna, steel insert, S-band transmitter circuit board, data recorder, sensor or measurement device and battery. The entire assembly is contained in such a way that the assembly can be threaded into the existing tracer well of a kinetic energy projectile.

12 Claims, 5 Drawing Sheets

HARDENED SUBMINITURE TELEMETRY AND SENSOR SYSTEM FOR A BALLISTIC PROJECTILE

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

The present invention relates to telemetry systems in general and more specifically to a system for instrumenting a ballistic projectile with a miniaturized sensor(s) and a telemetry system for testing and evaluation.

2. Discussion of Related Art

The in-flight measurement of artillery projectile flight dynamics (acceleration, pitch, yaw, spin and derivative thereof) or diagnostics of on-board devices (fuzing, warhead, etc) has been routinely accomplished at the Amy Research Laboratory. In most applications, commercial telemetry subsystems such as voltage controlled oscillators, transmitters, antennae, sensors, etc., could be located in either the nose, ogive, body, base or in some cases, all sections of the projectile. Typical volumes for these systems could range from 9 cubic inches to 27 cubic inches depending on the application.

Another example of prior art is as such, a test engineer wants to measure spin and yaw on a KE projectile. Kinetic energy projectiles, such as the one featured in FIG. 1, usually consist of a long slender rod, a pointed windshield, and a small set of fins. There isn't much room to install an instrumentation pack of any sort. The current state of the art process involves setting up several large placards in the flight path of the KE projectile. These placards are placed at precise distances from the muzzle of the gun tube. The KE projectile passes through these placards leaving fin-shaped holes. The engineer then has to digitize the shapes of the holes into a computer, where an algorithm determines the spin rate and attitude dynamics. This is usually accomplished from several minutes to several hours after the test has been performed.

A separate example of measuring spin was an experiment that Motorola performed at the Ballistic Research Laboratory. A spin stabilized, 105 millimeter KE training round was instrumented with a small device. The device incorporated a small power supply, transmitter and antenna. The device transmitted a pilot tone while the projectile was in free flight. The transmission used the C-band frequency, which is not compatible with military testing specifications. No sensor was incorporated into this device.

The current state of the art process of measuring projectile base pressure involves drilling small holes into the breech of a cannon tube and installing pressure gages. The gages measure the pressure event and a digital computer algorithm extrapolates the data to provide an estimate of the actual pressure and accelerations experienced by the projectile while travelling through the cannon tube. The procedure is very quick; however, the base pressure and the acceleration are still numerically derived. Future gun systems will be more complicated in design and difficult to instrument in the fashion previously mentioned.

SUMMARY OF THE INVENTION

Accordingly, it is an object of the present invention to provide a hardened subminiature telemetry and sensor system for a ballistic projectile.

Ballistic projectiles include kinetic energy (KE) projectiles, which are launched from a tank cannon, and artillery projectiles which are launched from artillery cannon. These types of ballistic projectiles are un-guided There is a need to provide a continuous measurement of the environments of both in-bore and free-flight events. The environments are severe since KE projectiles are launched from tank gun cannons at accelerations in excess of 100,000 g's. Artillery projectiles are launched with less acceleration, however, the projectiles exit the cannon with spin rates of about 18,000 revolutions per minute. The geometry of the KE projectile is a long, solid rod, with a thin pointed windshield and a small set of fins for stanbilization. With the exception of the tracer well cavity, there is no space on a KE projectile for an instrumentation package. Modifications to the projectile can create adverse effects to the trajectory and are therefore not allowed. Through the use of mini ed sensor(s), batteries, acceleration switches, signal conditioning electronics, transmitter and antenna, the present invention will provide simultaneous in-flight measurements of both the in-bore and free-flight environment. As soon as the projectile exits the cannon tube and is experiencing a free-flight trajectory, the present invention will telemeter the data to a nearby ground station. The sensors will measure projectile spin history, axial and transverse accelerations, pitch and yaw angles and rates, temperature, base pressure, or a combination thereof. This invention will improve the testing and evaluation of a projectile The invention is rugged, being capable of surviving temperatures in excess of 3500 degrees K, accelerations of 100,000 g's and spin rates in excess of 1,000 Hz. The invention is also extremely compact, taking up to 0.5–1.0 cubic inches of volume, thus making it much easier to instrument any projectile.

Ammunition testers could thread this invention into the existing tracer well of a KE projectile, as seen in FIG. 2, and measure the actual environment of the projectile continuously and more accurately. The tracer is a gas/flame generator which serves two purposes: first to help the gunner to track the projectile while in flight, and secondly, to reduce any base drag on the projectile. If a manufacturer need to test a specific lot of KE projectiles, the installation can be easily incorporated in the assembly. Instead of a tracer, the manufacturer can install the invention, which used the same threads as the tracer. The intent of the invention is not about the individual technologies or the miniaturized electronics, but the incorporation of the technologies into one device.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

Figure 1:
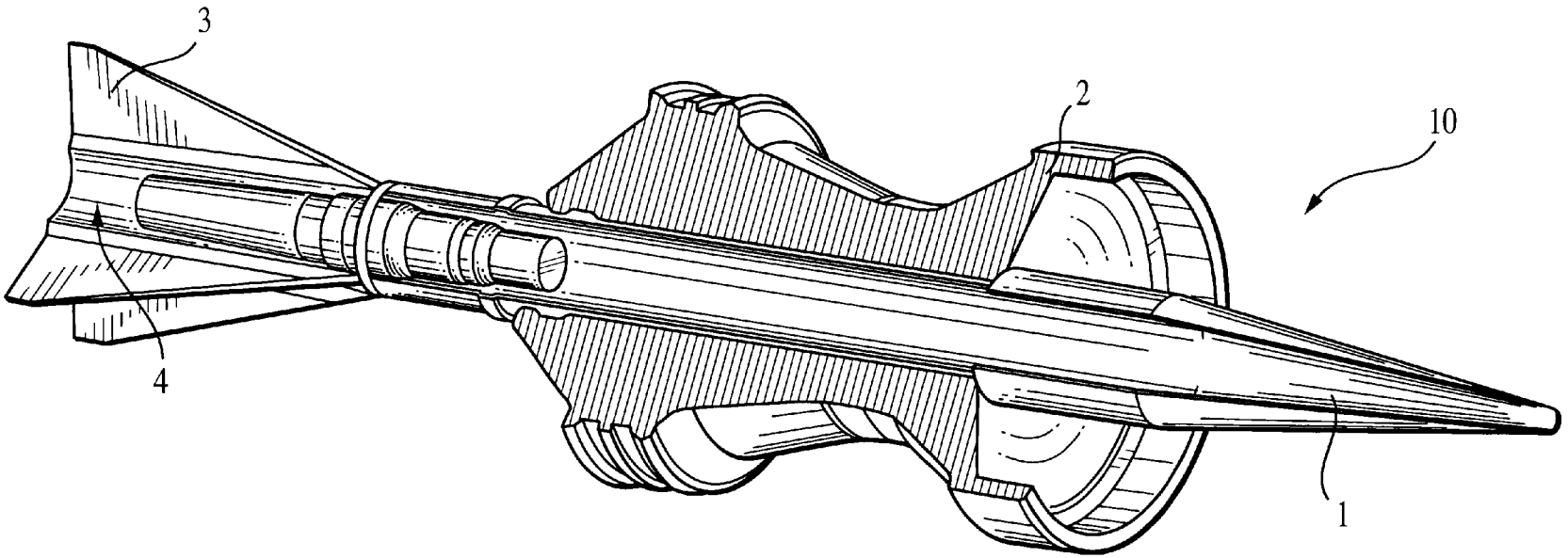
FIG. 1 is a view showing a typical Kinetic Energy Projectile.
Figure 2:
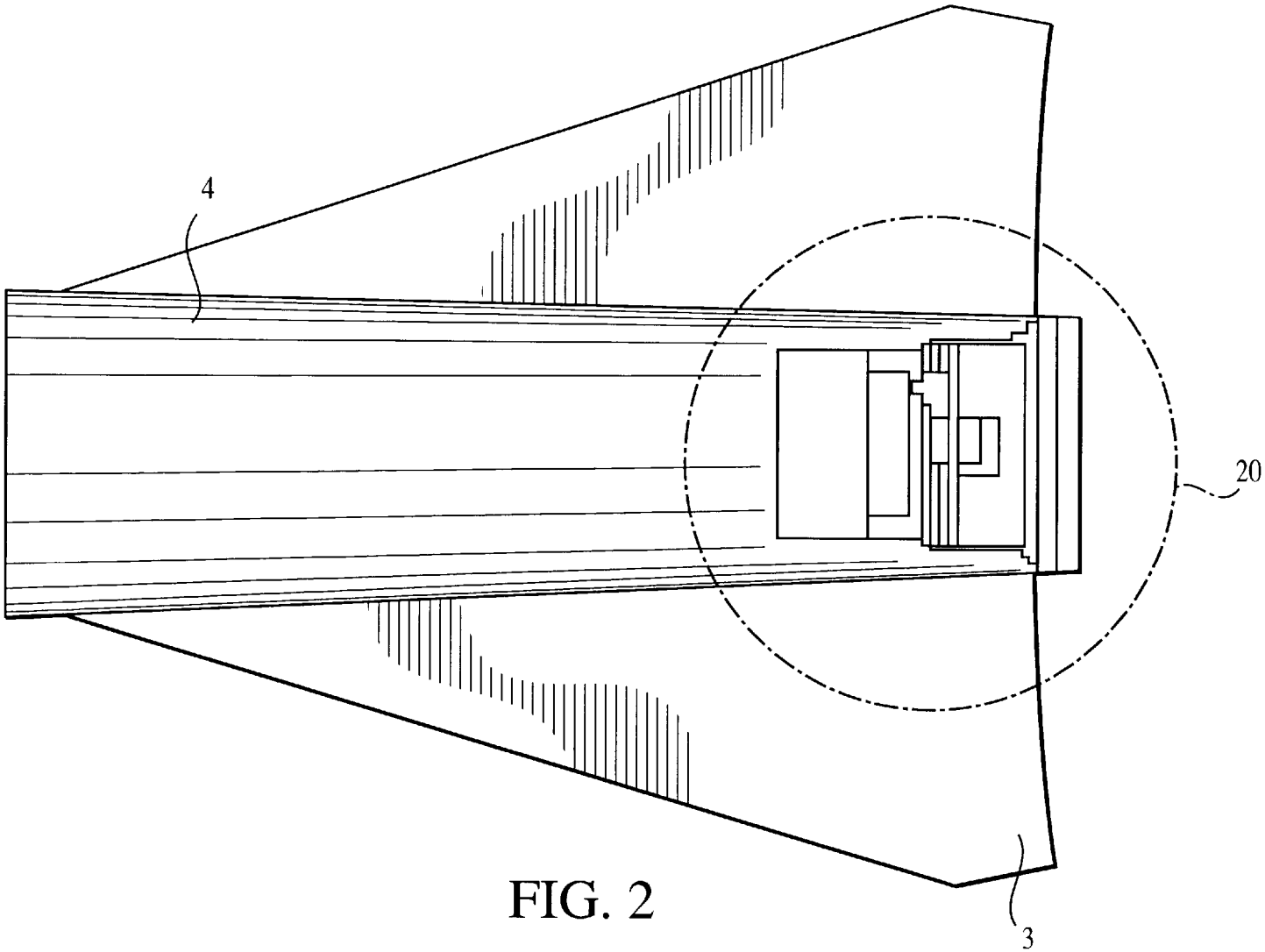
FIG. 2 shows the Hardened Subminiature Telemetry and Sensor System in the fin area of the Kinetic Energy projectile of FIG. 1.
Figure 4:
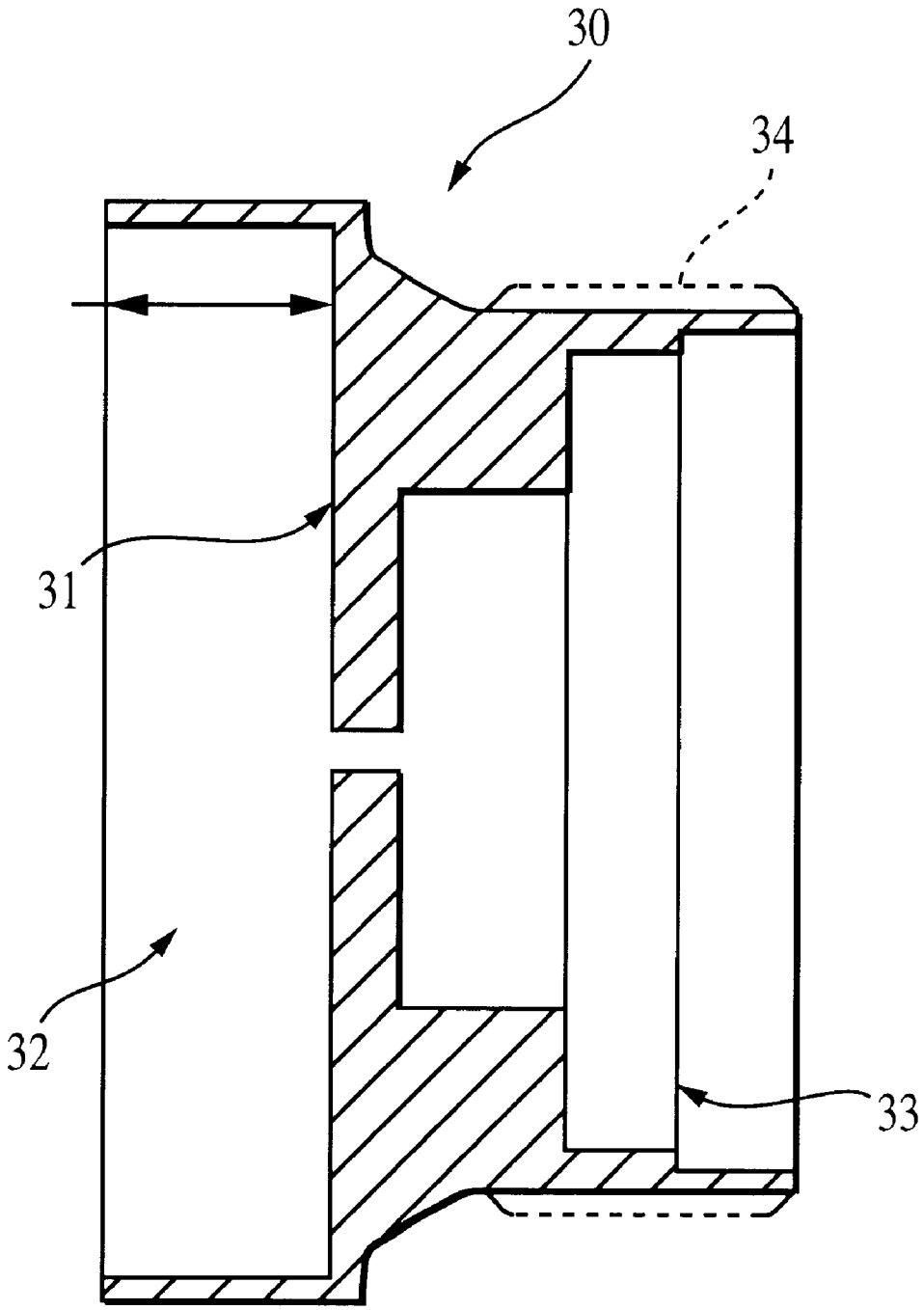
FIG. 4 shows the detail of the steel insert component of the Hardened Subminiature Telemetry and Sensor System.

Shown in FIG. 1 is a typical Kinetic Energy projection 10 which includes a windscreen 1, three sabot petals 2, fins 3, and tracer well 4. The entire assembly of sensors, the telemetry system and the power supply which comprise the present invention is contained in such a way that the assembly can be threaded into the existing tracer well 4 of kinetic energy projectile 10. As shown in FIG. 2, Hardened Subminiature Telemetry and Sensor System 20 is threaded into tracer well 4 of fins 3. A steel insert 30 (FIG. 4) is the housing within which system 20 is incorporated. An s-band antenna (linearly or circularly polarized) with a coaxial lead is placed into the non-threaded side of steel insert 30. The coaxial lead passes through a small hole in the firewall 31 of steel insert 30. FIG. 4 shows a detailed description of steel insert 30 which comprises firewall 31, antenna/radome assembly cavity 32, transmitter/sensors/signal conditioning/power supply cavity 33, and threaded portion 34.

Figure 3:
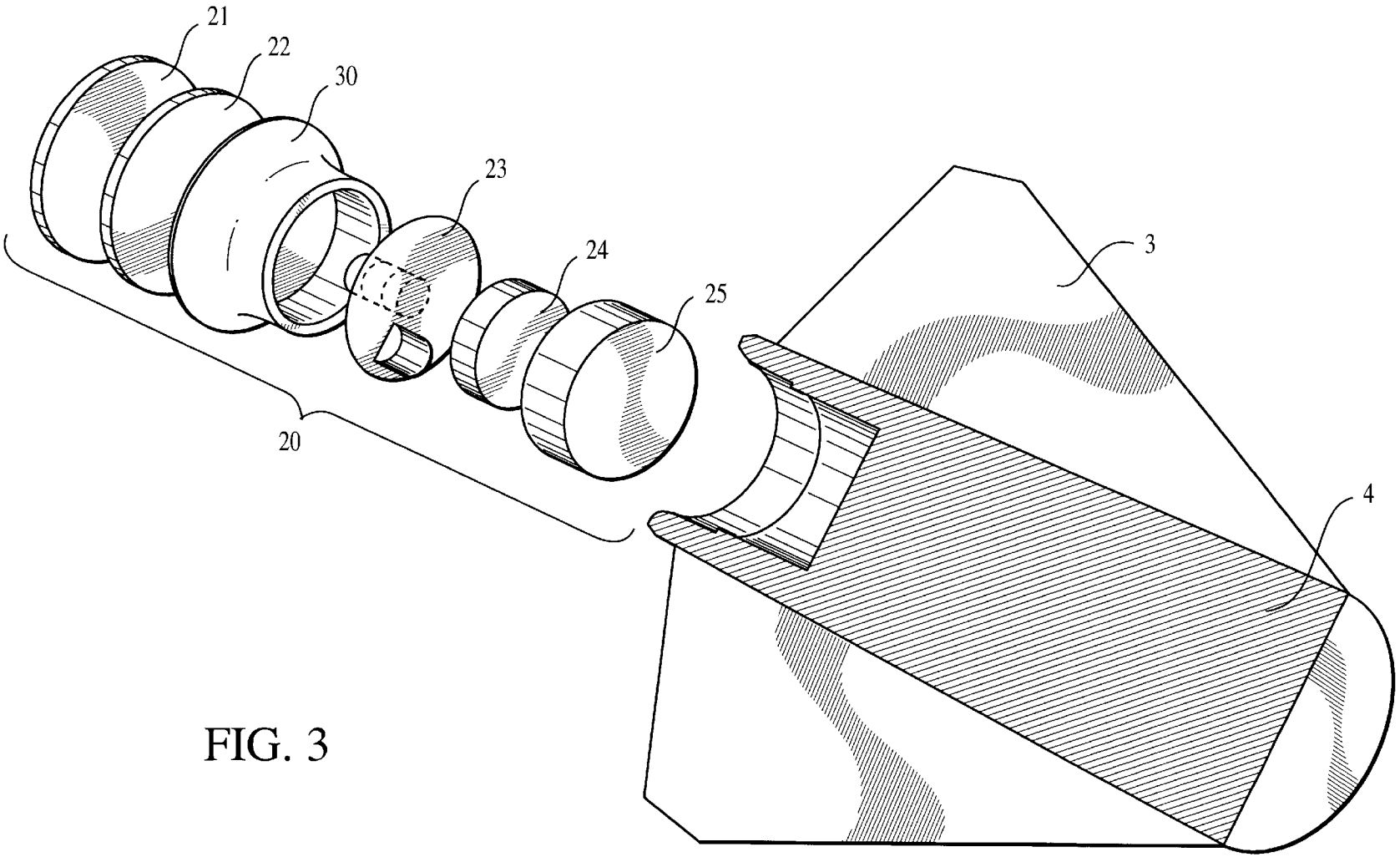
FIG. 3 shows an exploded view of the Hardened Subminiature Telemetry and Sensor System.

Shown in FIG. 3 is an exploded view of the Hardened Subminiature Telemetry and Sensor System 20. System 20 consists of radome 21, antenna 22, steel insert 30, S-band transmitter circuit board 23, data recorder 24, and battery 25. Electrical potting, preferably Stycast 1090-SI is applied to antenna 22 and protective radome 21 is then placed on top of antenna 22. The potting has a very small dielectric constant and loss tangent, so radiated energy from antenna 22 is not absorbed. This end of steel insert 30 is then crimped over the antenna/radome assembly. This process compresses the assembly together, removing any possible air gaps. An opening of about one-inch is diameter is left for antenna 22 to transmit through.

Figure 5:
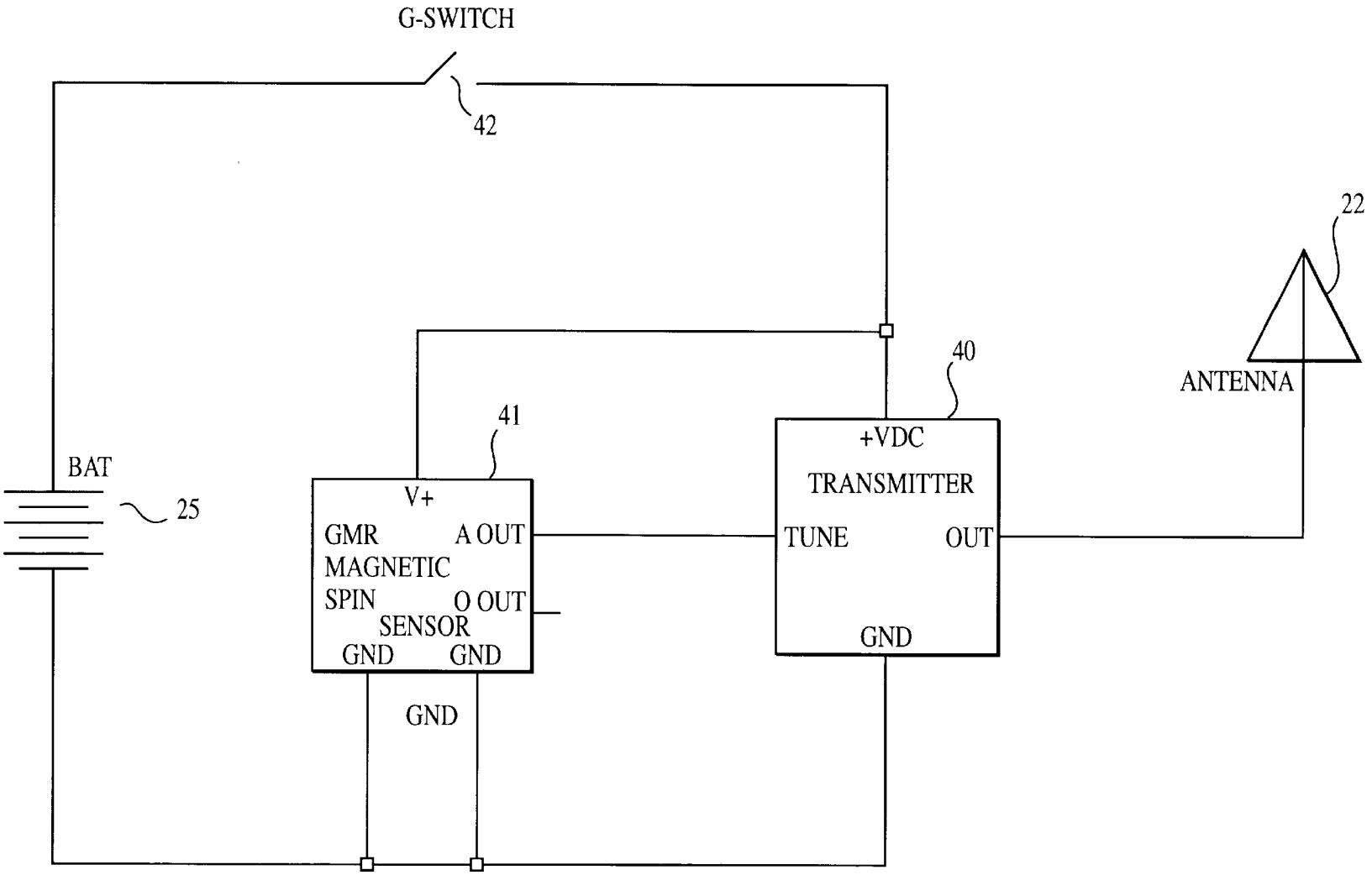
FIG. 5 is a block diagram of the Hardened Subminiature Telemetry and Sensor System.

Shown in FIG. 5 is an electrical schematic drawing of the miniature telemetry and sensor system 20. The miniature S-band transmitter board 23 includes a transmitter 40 and a magnetic spin sensor 41 powered from a miniaturized lithium manganese dioxide battery 25 through the intermediary of a latching g-switch 42. The telemetry and sensor system 20 may also include an integrated power amplifier and signal conditioning circuits (not shown) connected to antenna 22. As shown in FIG. 3, the miniature S-band transmitter board 23 sits inside the threaded side of steel insert 30. A miniature data recorder 24 is installed next followed by the miniaturized lithium manganese dioxide batter 25. Assembly 20 is placed into a mod and filled with electrical potting such as Stycast 1090-SI and allowed to cure. Ultimately, a thin metallic shell could be placed over the potted region to provide more protection.

Before the potting is applied, the system can be configured to accommodate various sensors. For example, magnetic spin sensors, accelerometers, and other rate sensors can be imbedded into the system by locating the sensor on a separate circuit board or incorporating it into transmitter board 23. Other sensors, such as a pressure or temperature sensor would have to be located at the point of measurement.

This system is then installed into KE projectile 10 via threads 34 on steel insert 30. Projectile 10 is now ready to be loaded into a cartridge. Before a test is conducted, the test engineer needs to set up a receiving antenna and data recording equipment. When projectile 10 is launched, Hardened Subminiature Telemetry and Sensor System 20 will transmit data while projectile 10 is in free-flight. If the sensors are measuring the in-bore environment of the launch phase, which lasts from seven to fifteen milliseconds, Hardened Subminiature Telemetry and Sensor System 20 will capture and play back the data after projectile 10 has exited the cannon tube.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A subminiature telemetry and sensor system for a ballistic projectile having a tracer well comprising:

a radome;

an antenna behind said radome;

a transmitter circuit board with electronic telemetry circuits thereon;

a data recorder connected to said circuit board;

a battery providing power to said circuit board;

at least one sensor for measuring an in-motion parameter of said projectile;

a housing means;

said radome, antenna, circuit board, data recorder, battery and said at least one sensor contained within said housing means and being operational to sense and telemeter parameter information;

said housing means having threads to mate with threads in said tracer well of said ballistic projectile and being sized to be retained entirely within said tracer well of said projectile.

2. The system of claim 1 wherein said circuit board with electronic telemetry circuits thereon includes an integrated power amplifier, signal conditioning circuits and a g-switch.

3. The system of claim 2 wherein said antenna comprises a linearly polarized antenna.

4. The system of claim 2 wherein said antenna comprises a circularly polarized antenna.

5. The system of claim 1 wherein said system has ability to survive an environment consisting of an excess of 100, 000 g's, 1,000 HZ spin rate, and temperature in excess of 3500 degrees.

6. The system of claim 1 wherein said at least one sensor measures the environment of said projectile while said projectile is traversing a launch tube.

7. The system of claim 1 wherein said at least one sensor measures the environment of said projectile while said projectile is in ballistic free flight.

8. The system of claim 1 wherein:

said housing means has a cylindrical configuration having a central axis and includes a firewall oriented transverse to said central axis to define a forward cavity and a rearward cavity, said radome and said antenna being positioned in said rearward cavity; and said circuit board, said data recorder, and said at least one sensor are positioned in said forward cavity.

9. The system of claim 8 wherein:

said firewall has a small hole therein for electrically linking said antenna to said circuit board.

10. The system of claim 9 wherein:

said ballistic projectile is a kinetic energy projectile comprising a long slender rod having a pointed windshield and a set of rear fins surrounding a rearward disposed tracer well.

11. The system of claim 10 wherein:

said housing means is made of steel.

12. The system of claim 1 wherein:

said ballistic projectile is a kinetic energy projectile comprising a long slender rod having a pointed windshield and a set of rear fins surrounding a rearward disposed tracer well.

* * * * *